US006360660B1

(12) United States Patent
Allison, Jr.

(10) Patent No.: US 6,360,660 B1
(45) Date of Patent: Mar. 26, 2002

(54) DOCTOR BLADE SYSTEMS

(75) Inventor: Thomas K. Allison, Jr., Moorestown, NJ (US)

(73) Assignee: Allison tech Sales Incorporated, Moorestown, NJ (US)

( * ) Notice: Subject to any disclaimer, the term of this patent is extended or adjusted under 35 U.S.C. 154(b) by 0 days.

(21) Appl. No.: 09/448,931

(22) Filed: Nov. 24, 1999

Related U.S. Application Data

(60) Provisional application No. 60/110,010, filed on Nov. 25, 1998.

(51) Int. Cl.[7] ..... B41F 1/00; A46B 15/00
(52) U.S. Cl. ..... 101/169; 15/256.51
(58) Field of Search ..... 101/167, 169, 101/155, 157, 425; 15/256.5, 256.51

(56) References Cited

U.S. PATENT DOCUMENTS

| | | | | | |
|---|---|---|---|---|---|
| 2,931,297 | A | * | 4/1960 | Coudriet | 101/157 |
| 3,186,335 | A | * | 6/1965 | Gaulin | 101/157 |
| 3,623,965 | A | * | 11/1971 | Owren | 101/157 |
| 4,009,657 | A | * | 3/1977 | Bonanno et al. | 101/169 |
| 4,735,144 | A | * | 4/1988 | Jenkins | 101/425 |
| 4,978,999 | A | * | 12/1990 | Frankel et al. | 15/256.51 |
| 5,110,415 | A | * | 5/1992 | Boucher et al. | 15/256.51 |
| 5,117,264 | A | * | 5/1992 | Frankel et al. | 15/256.51 |
| 5,138,395 | A | * | 8/1992 | Lindblad et al. | 15/256.5 |
| 5,356,519 | A | * | 10/1994 | Grabscheid et al. | 15/256.51 |
| 5,408,720 | A | * | 4/1995 | Miles | 15/256.51 |

OTHER PUBLICATIONS

Diagram of doctor blade/pre–wipe system, admitted prior art, undated.

* cited by examiner

*Primary Examiner*—Eugene Eickholt
(74) *Attorney, Agent, or Firm*—Akin, Gump, Strauss, Hauer & Feld, L.L.P.

(57) ABSTRACT

Doctor blade systems for rotary press ink stations, which include a print cylinder and an ink supplier on a side of the print cylinder to deliver ink to the surface of the print cylinder, have an elongated blade holder extending parallel to the cylinder on one side of the cylinder. The holder mounts a doctor blade, which may be conventional, and a pre-doctor or prewipe blade between the doctor blade and the pan on the one side of the cylinder. The holder includes a first clamp to releasably hold the generally flat, elongated doctor blade in axial line contact with an axial length of the outer circumferential surface of the print cylinder and a second clamp below the first clamp to releasably hold a generally flat, elongated prewipe blade against the outer circumferential surface of the print cylinder below the line contact of the doctor blade so as to remove some ink from the length of the surface before that surface reaches the doctor blade. Ink return openings are provided through the blade holder, the prewipe blade or both to permit ink removed from the cylinder by the doctor blade to be removed from the space between the doctor and prewipe blades. Ink supply ports may be provided on or through the holder to direct ink on the length of the cylinder surface between the prewipe and the doctor blade at low press speeds when the wiping action of the prewipe blade is more effective. The prewipe blade may be formed of metal, glass reinforced resin or thermoplastic material but has a relatively low coefficient of friction with respect to the surface of the print cylinder. The prewipe blade may be formed of resin materials that include a solid lubricant component for reduced wear. A backer or reinforcement may be used with a relatively soft and flexible prewipe blade to improve prewipe blade performance, reduce blade costs or both. The holder is typically mounted on a pivot to rotate towards and away from the image cylinder in gravure press ink units.

2 Claims, 5 Drawing Sheets

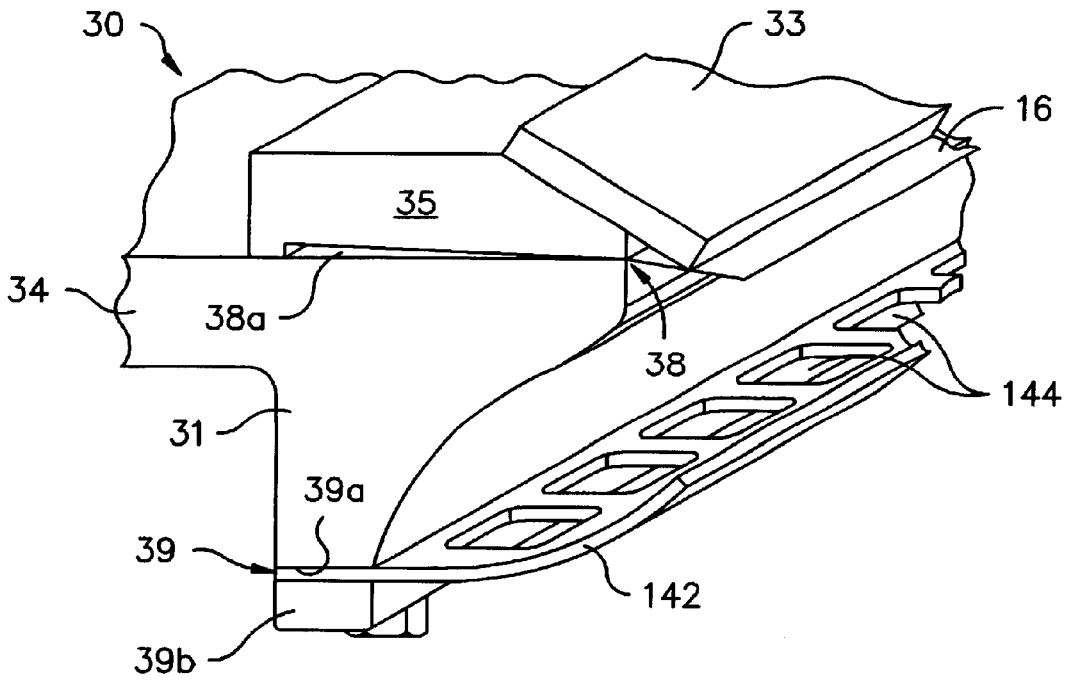
*Fig. 6*
*Fig. 7*
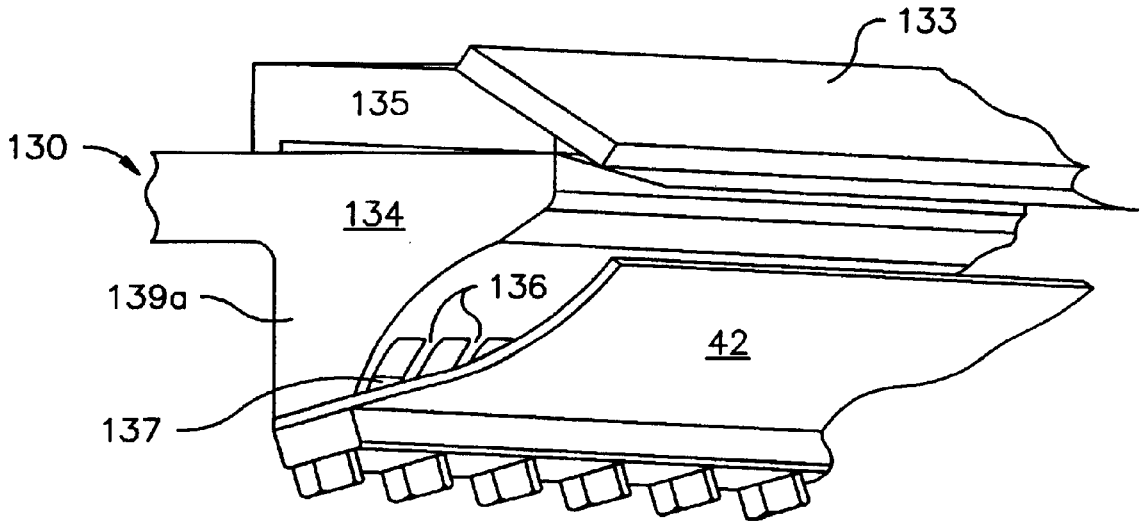

DOCTOR BLADE SYSTEMS

This application claims the benefit of provisional application No. 60/110,010, filed Nov. 25, 1998.

BACKGROUND OF THE INVENTION

Water-based gravure inks, which are now used extensively in carton, gift wrap and decorative product printing, have significantly different rheology, solids content, drying characteristics and other doctor blade wiping-related properties than the solvent-based inks they are replacing. Water-based inks typically have higher surface tension, decreased wetting properties and much higher pigment, binder and film forming solid content, which combine with the resultant lower liquid content to cause higher internal friction and static with restricted flow and lubrication properties of the wet ink on the press. Water-based inks employ such higher solids content with shallower etched cylinders to apply adequate pigment using thinner films so that less water is left to be removed during drying. These inks create relatively higher hydraulic force profiles at the doctor blade tip than did solvent based inks and lead to wiping defects at desired run speeds.

Many gravure doctor blade systems now in service using water based inks and other, high solid content or high viscosity inks and coatings, were originally designed for use with solvent based inks. The relatively greater hydraulic forces from these newer water based and other higher solids content inks on the tip of the doctor blade at the desired high press speeds tend to lift the doctor blade causing the passage of a visible film of ink under the blade in non-printing areas. This problem is referred to as haze.

Attempts have been made to compensate in solvent gravure ink systems for these changes in ink characteristics by applying additional force to the doctor blade to prevent haze. This typically results in greater doctor blade tip deflection and a smaller than desired contact angle between the blade tip and the cylinder. Additional force on the doctor blade typically causes more haze after a brief wear-in period. It can further cause dried ink entrapment behind the blade and various resulting print defects. Also, the higher solid content and greater resulting friction eventually causes additional gravure cylinder wear.

One attempted solution to the doctor blade problem has been the development of so-called "wear proof" doctor blades that can present small working tips to shear the ink from the gravure cylinder. For example, some doctor blades are now made of a special alloy steels with greater wear resistance than the knife steel and carbon steel blades conventionally used in solvent-based ink gravure cylinder blades. Some have special tip geometries that are supposed to improve shear performance. The success of these new blades is often limited by the performance of the remainder of the blade system, particularly the blade holder. The improved wear performance of such new blades does not overcome fundamental problems with doctor blade wiping force requirements, geometry and lubrication. Nor do they help alleviate the cylinder wear problem.

New gravure presses are often provided with a prewipe doctor blade of conventional construction, which is supported off the gravure roll journals, or with a separate rubber roll actually running in the ink sump to indirectly ink the gravure cylinder roll. Neither approach is easily or inexpensively implemented in older inking systems designed for use with conventional, solvent based inks.

BRIEF SUMMARY OF THE INVENTION

In one aspect the invention is an improved doctor blade system in a rotary printing press print station including a print cylinder having an axial direction and a circumferential outer surface and an ink supplier on a side of the print cylinder, the improved doctor blade system comprising: an elongated blade holder extending parallel to the cylinder and pivotally supported on one side of the cylinder for rotation towards and away from the cylinder; an elongated doctor blade mounted on the holder for line contact with axial length of the outer circumferential surface of the cylinder when the holder is rotated sufficiently towards the cylinder; and a prewipe blade mounted on the holder below the doctor blade for contact with the axial length of the outer cylindrical surface of the cylinder below the line contact of the doctor blade with the cylinder so as to wipe some of the ink from the length of the cylinder surface before the length of the surface reaches the doctor blade.

In another aspect, the invention is an improved doctor blade system in a rotary printing press print station including a print cylinder having an axial direction and a circumferential outer surface and an ink supplier located on a side of the cylinder, the improved doctor blade system comprising: an elongated blade holder extending parallel to the cylinder and supported on one side of the print cylinder; a first clamp on the holder configured to releasably hold a generally flat, elongated doctor blade and located to position the doctor blade in line contact with an axial length of the outer circumferential surface of the print cylinder; and a second clamp on the holder configured to releasably hold a generally flat, elongated prewipe blade and located to position the prewipe blade against the length of the outer circumferential surface of the print cylinder below the line contact of the doctor blade so as to remove some ink from the length of the surface before the length of the surface reaches the doctor blade.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings, which are diagrammatic:

FIG. 6 is a perspective view of a corner of a doctor blade holder of the present invention depicting one prewipe blade configuration of the present invention;

FIG. 7 is a perspective view of a corner of another doctor blade holder of the present invention depicting another prewipe blade configuration of the present invention;

DETAILED DESCRIPTION OF THE INVENTION

Figure 1:
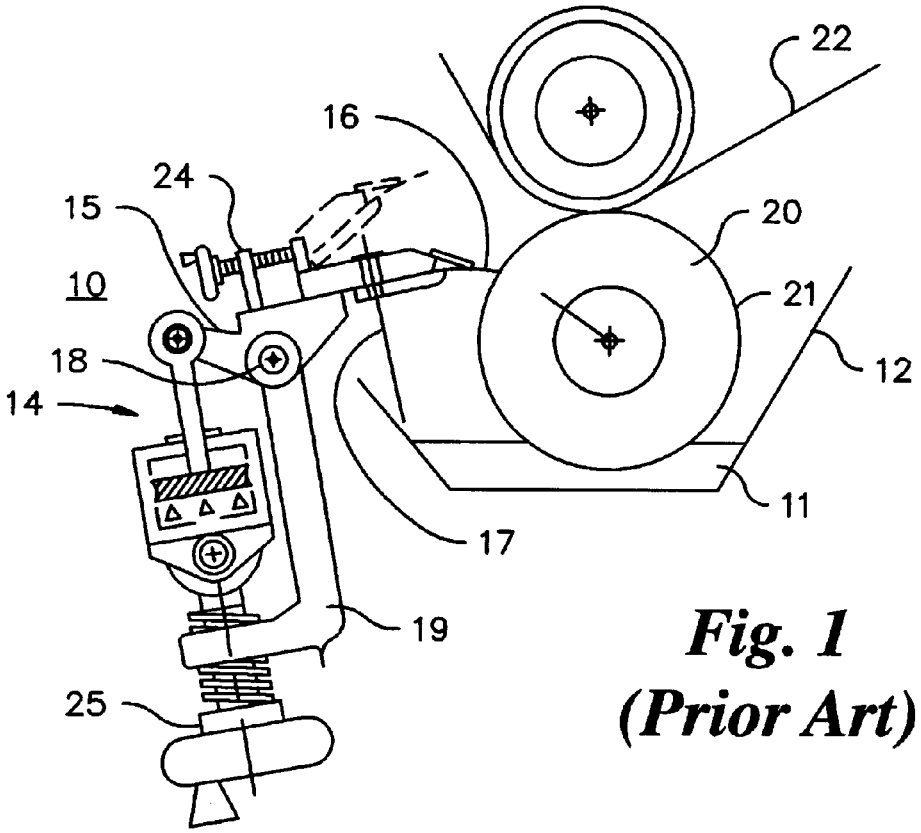
Fig. 1 (Prior Art)
FIG. 1 is a side elevation of a typical gravure cylinder ink unit of the type typically used for solvent based inks.

In the drawings, like numerals are used to indicate like elements throughout. In the present invention, novel doctor blade systems are provided that can be retrofitted into rotary presses, particularly gravure presses originally designed for solvent based inks. The geometry of a typical, prior art, solvent-based ink unit with doctor blade, which forms at least part of a print station in a rotary printing press, such as a gravure press employing several such stations in series, is shown in FIG. 1. The ink unit 10 includes an ink supplier in the form of a pan 12 containing ink 11. In different presses, the ink suppliers have different configurations and different locations. They may be open and vented to atmosphere as are gravure press pans typically, or sealed as are flexographic press ink chambers. The ink supplier may also include a roll which carries ink onto the surface of the print roll. All ink suppliers are located on a side of a print cylinder to at least apply ink to the circumferential surface of the print cylinder. In a typical gravure press, the pan 12 has an open top receiving at least a lower side of a print cylinder 20. The cylinder 20 may be rotated in the ink 11 in the pan 12 as shown or above the pan 12 with ink delivered to the lower side of its outer circumferential surface 21 by an ink supply header or manifold or by a transfer roll or by other conventional means (none depicted). The cylinder 20 applies the ink to a flexible web 22 typically passed over an upper side of the cylinder. A doctor blade system indicated generally at 14 includes a doctor blade holder 15 which releasably holds a doctor blade 16 and positions the blade 16 in line contact with a length of the outer circumferential surface 21 of the cylinder 20 between the pan 12 and the flexible web 22 in a direction parallel to the axial (center line) direction of the cylinder 20, in and out of the plane of FIG. 1. The holder 14 may also support a splash shield 17 positioned below the doctor blade 16 and extending away from the cylinder 20. Pivotal mount(s) 18 are provided to support the holder 15 on a fixed support 19 for rotation and, in many cases, removal. Means for adjustments 24, 25 are typically provided on and/or for the holder 14. The doctor blade system 13 may be mounted on a wheeled cart with the gravure cylinder for movement together to and from the press together with the pan 12 or may be supported from the framework of the press over the pan 12 at the print station separately from the cylinder 20.

According to the invention, new types of doctor blade holders are provided which can be retrofitted into typical existing printing press print stations, particularly those of many gravure printing presses having ink units like unit 10 originally designed for use with solvent-based inks, in place of the existing, removable doctor blade holders with no or only relatively minor modifications. The new doctor blade holders provide improved doctoring for water-based and higher solid content inks and enhance the performance of the doctor blades used in the system, including the newer, wear-resistant doctor blades described above, by means of a pre-doctor or prewipe blade, which removes most of the ink from the cylinder to reduce hydraulic forces on the doctor blade.

Figure 2:
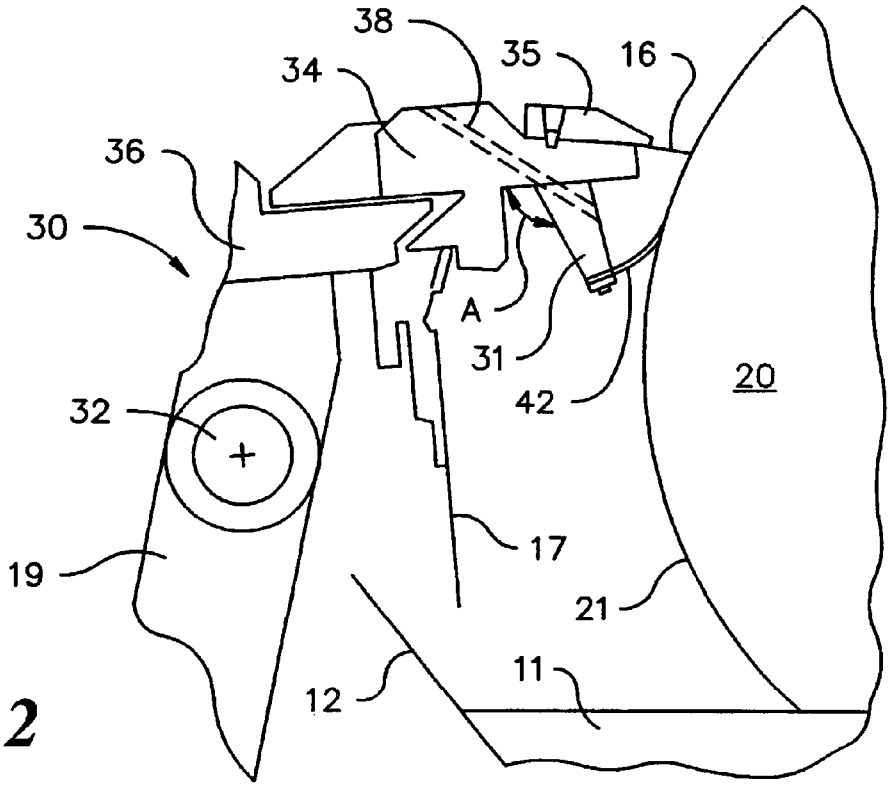
FIG. 2 is a side elevation of a doctor blade system of the present invention.

More specifically and preferably, a first exemplary doctor blade holder of the present invention is indicated generally at 30 in FIG. 2. Holder 30 includes one or more pivots 32 on which the holder 30 is removably and rotatably mounted for rotation towards or away from the print cylinder 20. Holder 30 preferably releasably and replaceably holds a doctor blade 16 for line contact with an axial length of the outer circumferential surface 21 of the cylinder 20 when the holder 30 is rotated sufficiently towards the cylinder 20. Holder 30 is a curve type including a holder body 34, a clamp member 35, and a deck 36 adjustably supporting the body 34 and clamp member 35. The deck 36 is pivotally mounted to fixed support 19. Clamp member 35 is releasably secured to the body 34 by conventional means, typically mechanical threaded fasteners, cams and/or toggle (over center) clamps. Holder 30 further preferably includes a transverse support 31 which releasably and replaceably holds a pre-doctor or prewipe blade 42 below the doctor blade 16. The prewipe blade 42 is positioned against an axial length of the outer circumferential surface 21 of the print cylinder 20 below the line contact of the doctor blade 16 with the cylinder 20 when the holder 30 is rotated toward the cylinder 20 sufficiently to bring the doctor blade 16 into contact with the cylinder. The prewipe blade 42 is located in a position in front of or leading the doctor blade 16 with respect to the advancing circumferential surface 21 of the cylinder 20. The prewipe blade 42 is preferably mounted with respect to the holder 30 to contact the cylinder 20 in a trailing position, dragging across the outer circumferential surface 21 of the cylinder 20. Holder 30 may also mount a splash shield 17 extended away from the cylinder 20 and below the doctor blade 16 and the prewipe blade 42.

Figure 3:
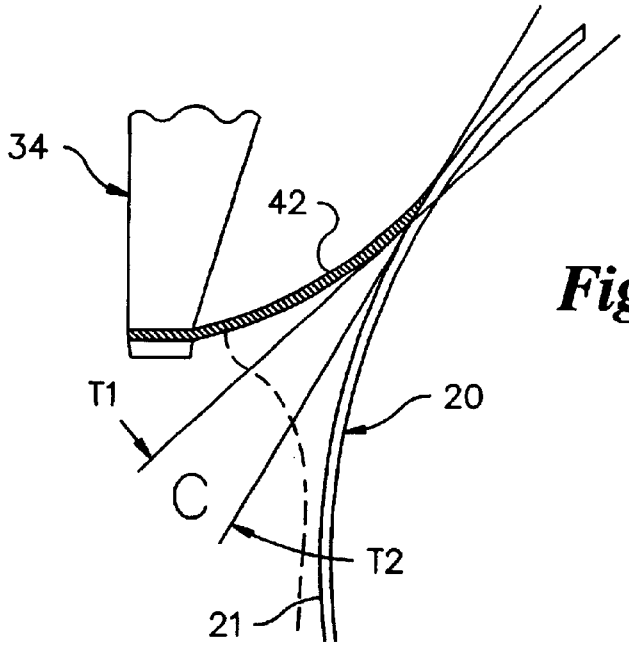
FIG. 3 depicts a prewipe blade contact angle, C.

Referring to FIG. 3, a prewipe blade 42 is shown applied to the outer circumferential surface 21 of a print cylinder 20 at a contact angle C. The contact angle C is the included angle between a tangent T1 to the cylinder 20 at the first point of contact of the prewipe blade 42 and a tangent T2 to the prewipe blade 42 at the first point of contact of that blade 42 with the cylinder 20. Where the free end of the prewipe blade 42 ends beyond its point of contact with the cylinder 20 (not depicted), the contact angle C is about 0°. The contact angle C of a prewipe blade 42 having a tip in contact with the cylinder 20 as shown in FIG. 3 would generally be between about 5° and about 30°, typically about 10° or less, to achieve the necessary amount of prewipe to print without haze. The prewipe blade 42 is intended to remove only some of the ink carried by the cylinder 20 at operating speed before it reaches the doctor blade 16 proper to reduce the hydraulic pressure applied to the doctor blade 16 by the ink layer 11 a raised on the cylinder 20. At operating cylinder surface speeds, which can be about 800 feet per minute or more for high speed gravure presses, the ink layer 11*a* lifted by the cylinder 20 may be one-quarter inch or more thick. Prewiping by the prewipe blade 42 enables the doctor blade 16 to handle a much thinner ink layer and achieve an efficient, haze-free wipe at a relatively low to moderate force on the cylinder 20. Without prewiping, much higher forces would be required on the doctor blade 16 to keep the blade 15 in direct contact with the cylinder surface because of the high solids content and surface tension of typical water-based and certain other inks and the wiping geometry built into the typical solvent-based ink holder and ink delivery/recirculating system.

Figure 4:
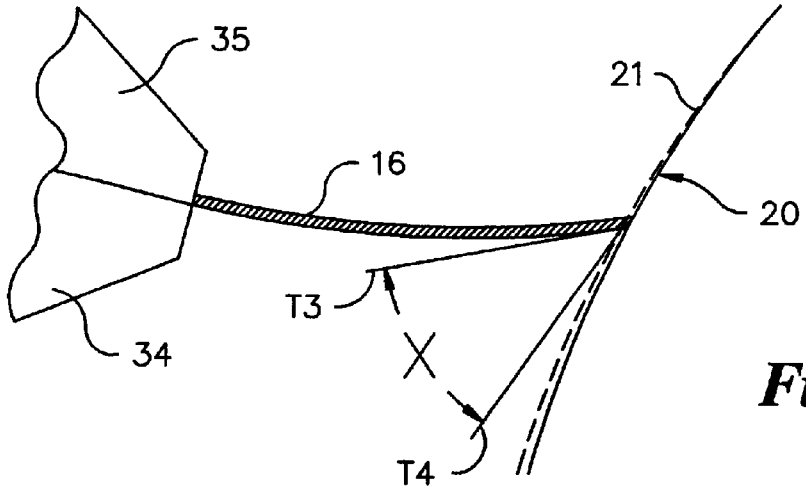
FIG. 4 depicts doctor blade contact angle, X.

For further reference, FIG. 4 depicts the contact angle, X, of the doctor blade 16 with the print cylinder 20, which is the included angle between a tangent T3 to the doctor blade 16 at the point of contact of that blade 16 with the outer circumferential surface 21 of the print cylinder 20 and a tangent T4 to the surface 21 of the print cylinder 20 at the first point of contact of the doctor blade 16. The doctor blade contact angle X essentially determines the hydraulic lifting or lubricating force of the ink under the doctor blade tip.

Doctor blade contact angles of less than 45° usually will result in significant ink passage under the blade leading to hazing. Thus, in normal circumstances, the contact angle X of the doctor blade 16 should exceed the contact angle C of the prewipe blade 42. Also, in normal circumstances, the spacing between the first point of contact of the prewipe blade 42 and the first point of contact of the doctor blade 16 with the cylinder surface 21 is "D" in FIG. 2 and varies with cylinder diameters. For gravure printing, cylinders have print (celled) faces one to two hundred forty inches in length with most at least thirty inches in length, with circumferences of from three to ninety inches. Spacing "D" between prewipe and doctor blade first points of contact would range from about one-eighth inch for a three inch circumference cylinder up to about one and one-quarter inch for a ninety inch circumference cylinder with spacing generally proportional to circumferential cylinder length in between.

Figure 5:
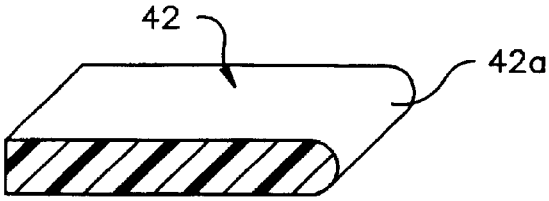
FIG. 5 is a perspective view of a corner of a prewipe blade.

According to another aspect of the invention, the prewipe blade 42 is preferably made of a softer material than the material of the doctor blade, which is typically 1% carbon steel spring tempered to a hardness of 48–56 Rockwell (C scale), generally about 0.004–0.008 inches thick. The actual material of the prewipe blades 42 may vary with the surface material of the print cylinder and its normal operating speed. The prewipe blade 42 should be made of a relatively soft, self-lubricated or low friction material, which can safely ride directly on the outer surface of the cylinder 20 when the press is idling. The prewipe blade 42 may be reinforced by bonding to or backing against a harder spring material. Suitable backing materials include, but are not limited to, a bonded glass reinforced epoxy or a separate metal backer made, for example, of spring steel or other spring metal or the like, as well as any other conventional doctor blade backing material. The prewipe blade 42 presently preferred for use with conventional, chrome plated gravure cylinders is made of 0.030–0.090" thick nylon filled with the dry lubricant, molybdenum disulfide (MDS), suggestedly about 0.7% to about 2.2% by volume and about one to five microns in size. The MDS is transferred by contact to the metal coating on the surface 21 of the rotating cylinder 20 at low (e.g. idle) speeds. The prewipe blade material could be another thermoplastic material such as ultra high molecular weight polyethylene (with or without MDS or other dry lubricant) or a similar, low-friction plastic material. Referring to FIG. 5, suggestedly the extreme tip 42*a* of the prewipe blade 42 is rounded as shown in FIG. 5 to provide better lubrication at low speeds. The rounding will avoid a small corner or flat in contact with the cylinder 20 before the prewipe blade 42 "wears in" and will provide more ink passage past the prewipe blade at low (e.g., press idle) speeds. Prewipe blades 42 made of glass reinforced plastic compose of material incorporating a dry lubricant such as powered graphite (about one to about four microns in size) or without a lubricant but with a low, coefficient of friction can be used with other cylinder materials such as ceramic gravure cylinders with antiwear coatings such as tungsten carbide or laser engraved chrome oxide. Again, tip 42*a* is suggestedly rounded.

For plastic, rubber or photopolymer gravure cylinder surfaces, prewipe blades 42 are suggestedly made of plastic or spring tempered metal such as AISI 1095 spring steel or 400 series stainless steel with a low coefficient of friction for the cylinder surface material. Again, the tip 42*a* is suggestedly rounded for better low speed lubrication.

Figure 8:
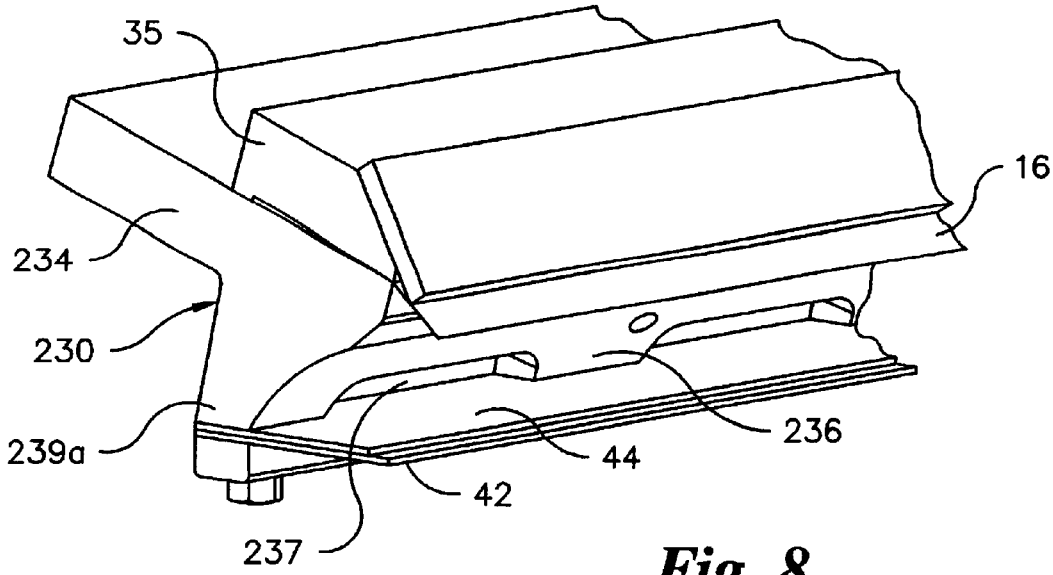
FIG. 8 is a perspective view of a corner of the doctor blade holder of FIG. 6 depicting another prewipe blade configuration with backer or reinforcement.

In situations where very high operating speeds (e.g. about 1300 ft./min. or more) or high ink lifting forces such as those generated by certain ultra-violet cured and other, high solid level inks are to be encountered, it may be necessary or desirable to provide a backing or reinforcement 44 to the prewipe blade 42. Referring to FIG. 8, backing or reinforcement 44 is preferably provided on a "rear" or upper side of the prewipe blade 42, facing away from the surface of the cylinder 20, and suggestedly extends to within about ½ to ¼ inch of the tip of the prewipe blade contact with the cylinder, to maintain a spring force on the prewipe blade 42 and keep the blade 42 from lifting excessively from the cylinder 20. The reinforcement or backing 44 may be bonded to the prewipe blade 42 or clamped together with it in the holder 30. A separate, reusable backer 44 clamped together with the cylinder contacting prewipe blade 42 may be desirable generally for cost savings as it would permit thinner, lower cost prewipe blades to be used.

Another separate but related aspect of the invention includes a blade holder system 13 provided with a plurality of ink supply ports preferably carried on or cut through or in the doctor blade holder like ports 38 (in phantom) in FIG. 2 cut through the body 34 of holder 30, or otherwise provided to allow a relatively small amount of ink to be supplied directly on the circumferential outer surface 21 of the print cylinder 20 above the prewipe blade 42 in the vicinity of the tip of the doctor blade 16, to provide ink lubrication to that blade 16. These parts can be connected through flow restricting valves to the ink supply pump discharge line through flexible hoses which move with the holder 30. It may be necessary or desirable to supply supplemental ink to the cylinder 20 in this way at least while the press and cylinder are being run at idle speeds and until press speed is again sufficient to allow more ink to pass under the prewipe blade 42.

Yet another aspect of the invention is the provision of ink return openings through at least one of the doctor blade holder and the prewipe blade to avoid hydraulic pressure build-up in the space between the doctor and prewipe blades, to allow ink removed by the doctor blade 16 to flow back into the ink pan 12 so as to be recirculated and to avoid drying/pigment kick out and/or particle build up under the doctor blade 16. FIG. 6 depicts the doctor blade holder 30 with a prewipe blade 142 having a plurality of generally square or rectangular ink return openings 144 extending through it. FIG. 6 also provides another view of the two clamps formed by pairs of jaws that are provided on the holder 30 to hold both blades 16 and 42/142. The elongated body 34 has outer surfaces 38*a* and 39*a*, which define a first jaw of each clamp 38 and 39, respectively. A separate, at least releasable member 35 forms the other jaw of the doctor blade clamp 38, which releasably holds the doctor blade 16 to the holder 30. A separate, at least releasable member 39*b* forms the second jaw of the second, prewipe blade clamp 39, which releasably holds the prewipe blade 42 to the holder 30. Each of the clamps 38 and 39 defines on a straight slot which receives a respective blade and which extends in a direction pointing to the cylinder surface 21.

FIG. 7 depicts a modified holder 130 with an elongated body 134 having a plurality of openings in the form of recesses 137 along a bottom wall 139*a* which form one jaw of a clamp supporting the prewipe blade 42. Recesses 137 form a plurality of individual supports 136 along the bottom of the holder body 132. Ink removed by the prewipe blade 42 falls directly back into the pan while ink removed by the doctor blade 16 flows over the surface of the prewipe blade 42 and between the prewipe blade supports 136, to fall back into the pan. The prewipe blade 42 is mounted in a conventional fashion to the several supports 136 extending from the doctor blade holder body 132 through threaded mechanical fasteners 139 or cams.

Figure 9:
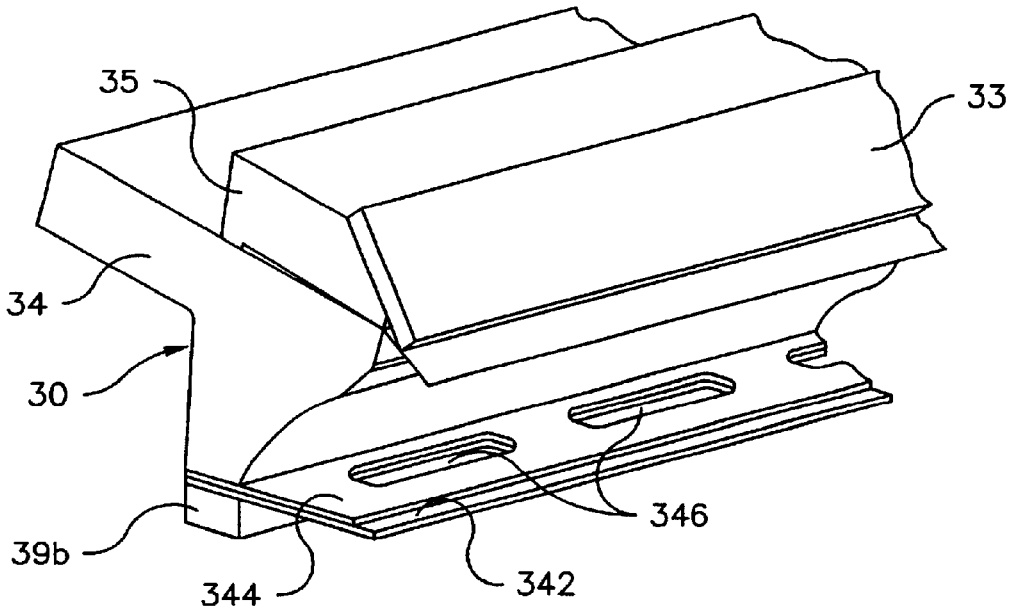
FIG. 9 is a perspective view of a corner of yet another doctor blade holder of the present invention depicting yet another prewipe blade configuration.
Figure 10:
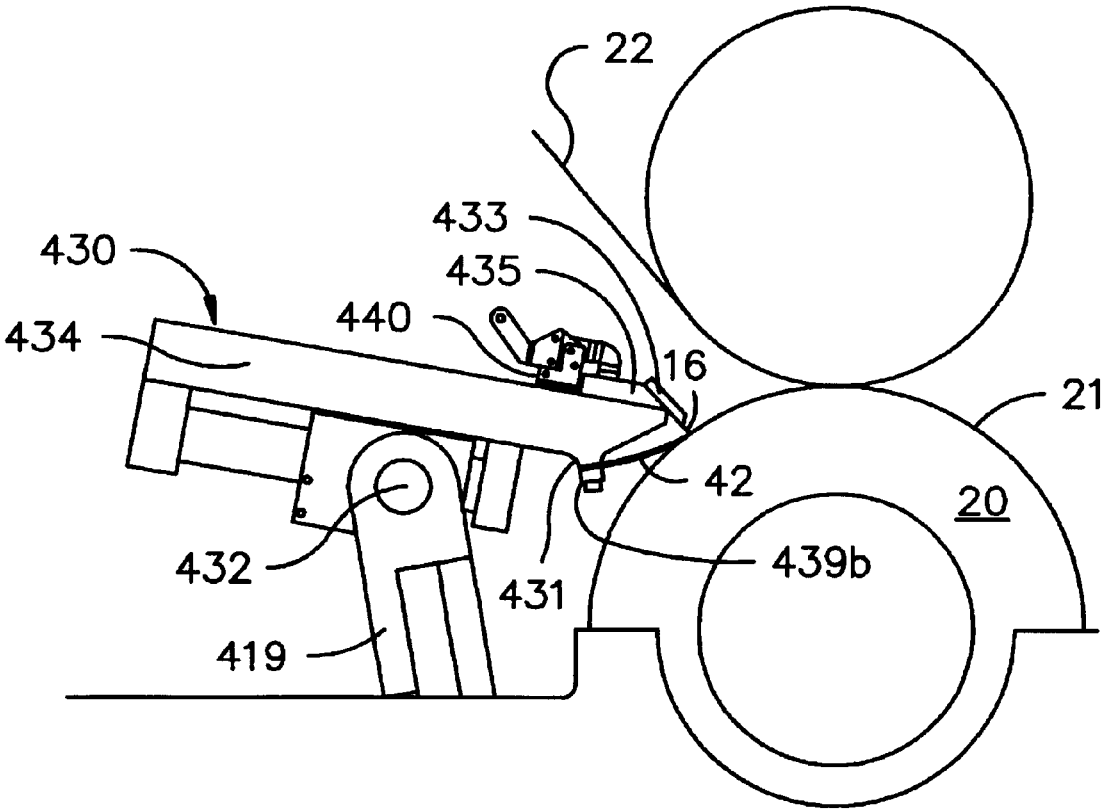
FIG. 10 is a side elevation of a doctor blade system of the present invention in a fixed configuration.

FIG. 8 depicts a curved type of elongated blade holder 230 with elongated body 232 having a plurality of openings 234 along a bottom wall 239*a*. The openings 237 define a plurality of individual, downward extending supports 236 receiving an elongated, solid prewipe blade 42 and an elongated solid backer or reinforcement 44. FIG. 9 depicts holder 30 supporting an elongated prewipe blade 342 and a reinforcement or backer 344 with aligned openings 346 therethrough. FIG. 10 illustrates the incorporation of a doctor blade holder 430 of the present invention into a newly manufactured "fixed" doctor blade system typically found in larger, "publication" presses. Holder 430 includes a body 434, which is mounted on pivots 432 but not removably mounted to a fixed support 419 of the press. The holder 430 releasably holds and positions a doctor blade 16 and a prewipe blade 42 against the outer circumferential surface 21 of print cylinder 20 rotating in pan 12. The holder illustrates one of a plurality of overcenter* toggles 440 provided to hold a clamp member in the form of a bar 435 against the body 434 to releasably hold the doctor blade 16. Another bar 439*b* releasably holds the prewipe blade 42 to prewipe support 431 projecting transversely from the body 434. The bar 39*b* is releasably fixed to the support by conventional threaded fasteners (e.g. bolts).

It should be appreciated that FIGS. 6 and 7 illustrate how the prewipe blades 42/142 would be deflected in use when pressed against the surface of a typical cylinder, which has been omitted from each of those figures to more clearly show the blade systems. FIGS. 8 and 9 illustrate how the prewipe blades 42/342 and their backers 44/344, respectively, would appear pivoted away from the cylinder and undeflected.

While the present invention was intended primarily for use with gravure press ink units, it will be appreciated that the invention or at least major aspects could be used or adapted for use with other types of print cylinders and stations, particularly flexographic, as well as with other types of printing and/or coating rolls. In chambered flexographic ink units, the prewipe blade would be supported from an inner wall (typically the back wall) of the chamber. Also, while the various figures show various typical doctor blade angles, it should be noted that the doctor blade angles X may be altered relative to the cylinder 20 and the reversal of the doctor blade to a leading orientation rather than the trailing orientation shown in FIGS. 2 and 4 (i.e. like conventional flexographic doctor blades) is contemplated within the scope of the doctor blade systems of the present invention.

Referring to FIG. 2 again, the prewipe blade support 31 extends generally transversely from the body 34 and bar 35 supporting the doctor blade and the support 31 preferably forming an angle "A" of between about seventy and about one-hundred twenty degrees. The resulting angled configuration of the holder 30 provides increased structural rigidity against longitudinal bending compared to conventional, generally planar doctor blade holders lacking such a support or similar transverse, blade supporting projection from the doctor blade supporting body of the holder between the doctor blade and the pivot(s) supporting the holder. This angle configuration permits the holders of the present invention to be made of thinner and/or lighter weight aluminum, plastics and composite materials (i.e., plastic resin reinforced with glass, ceramic or metal fibers or filaments) instead of the steel traditionally used in planar doctor blade holders for strength and rigidity.

The present invention controls prewipe action at all operating speeds and its design avoids significant increases of print cylinder wear and/or the creation of print defects due to the presence of a second blade in contact with the print cylinder. The prewipe blade functions with no discrete operator setting procedure or adjustment during the press run. Improved doctoring because of reduced hydraulic forces on the main doctor blade eliminates the need to attempt doctor blade readjustments to compensate for these forces. Furthermore, the position and configuration of the prewipe blade allows the doctor blade to be set with the press at idle speed (e.g., 2 to 10 ft./min. cylinder surface speed) in the same manner it would be set with no prewipe blade present.

More particularly, the invention's prewipe blade is flexed against the gravure cylinder with the press at idle. The invention's geometry and choice of prewipe blade thickness and material determines the prewipe blade force normal to the cylinder and the coefficient of friction against the cylinder surface. With a slotted or non-slotted blade configuration, the normal force is about 0.1 to about 0.5 lb. per linear inch of prewipe blade against the cylinder face. At high running speeds, about 500–1500 feet per minute, hydraulic forces will lift the blade slightly off the cylinder. Stiffness properties of the prewipe blade and support blades if needed are chosen to operate in this range, and would be at the high end of the range at high speed and conversely.

When plastic or filled plastic prewipe blades are used against chromium plated cylinders, the dry coefficient of sliding friction must be less than or equal to about 0.16 at 70 degrees F. against the chrome plated surface with a surface roughness Rz of about 15 micrometers or less. Lubrication effects on the coefficient of friction caused by the ink passing under the prewipe blade at idle will be highly variable at idle due to different lubricating properties of different colors of ink going from print station to print station as well as normal differences in viscosity and the coefficient of friction, which cannot generally be determined, but should be less than the dry sliding friction coefficient about 0.16 which at 70 degrees F. for the invention to work optimally.

When hardened steel, tool steel or composite prewipe blades are used against chrome oxide or other ceramic cylinders, the dry coefficient of friction against the surface is suggestedly less than or equal to about 0.20 for the invention to work optimally. This will generally require an Rz of about 15 micrometers or less on the ceramic roll surface. As with chrome rolls, lubrication effects on the coefficient of friction caused by the ink passing under the prewipe blade at idle will be highly variable at idle due to different lubricating properties of different colors of ink going from station to station as well as normal differences in viscosity and the coefficient of friction, which cannot generally be determined, but should be less than the dry sliding friction coefficient of about 0.20 at 70 degrees F. for the invention to work optimally.

Drain-back slots, provided in the prewipe blade or holder body should have a minimum flow area of about 3 square inches per linear foot of prewipe blade and a maximum of about 5 square inches per linear foot of prewipe blade. The ratio of the axis of the slots parallel to the length of the prewipe blade to the axis perpendicular to the length of the prewipe blade (the slot depth) suggestedly should be between about 0.4 and about 0.6 and the minimum slot dimension and/or corner radius is suggestedly about 0.0625 inches. The minimum slot depth is suggestedly about 0.125 inches. These relationships are determined based on hydraulic pressure and ink debris blockage considerations.

Suggestedly, the thickness of the prewipe blade 42 outwardly from its clamp point or the prewipe blades 142, 342 beyond their cutouts 144, 344 is about one-sixteenth of an inch or less for a resin body blade and about eight mils or less for a metal body blade for flexure conformance to the print cylinder, for example, in the case of misalignment.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. In a rotary printing press print station including a print cylinder having an axial direction and a circumferential outer surface and a ink supplier on a side of the print cylinder, an improved doctor blade system comprising:

an elongated blade holder extending parallel to the cylinder and pivotally supported on one side of the cylinder for rotation towards and away from the cylinder;

an elongated doctor blade mounted on the holder for line contact with an axial length of the outer circumferential surface of the cylinder when the holder is rotated sufficiently towards the cylinder;

a prewipe blade mounted on the holder below the doctor blade for contact with the axial length of the outer cylindrical surface of the cylinder below the line contact of the doctor blade with the cylinder so as to wipe some of the ink from the length of the cylinder surface before the length of the surface reaches the doctor blade; and a plurality of ink supply ports located on the holder so as to direct ink on the length of the outer circumferential surface of the cylinder between the prewipe blade and the doctor blade.

2. In a rotary printing press print station including a print cylinder having an axial direction and a circumferential outer surface and a ink supplier on a side of the print cylinder, an improved doctor blade system comprising:

an elongated blade holder extending parallel to the cylinder and pivotally supported on one side of the cylinder for rotation towards and away from the cylinder;

an elongated doctor blade mounted on the holder for line contact with an axial length of the outer circumferential surface of the cylinder when the holder is rotated sufficiently towards the cylinder; and a prewipe blade mounted on the holder below the doctor blade for contact with the axial length of the outer cylindrical surface of the cylinder below the line contact of the doctor blade with the cylinder so as to wipe some of the ink from the length of the cylinder surface before the length of the surface reaches the doctor blade wherein the prewipe blade includes an embedded dry lubricant and some of the dry lubricant is transferred by contact to the cylinder.

* * * * *